US008205872B2

(12) United States Patent
Yamauchi et al.

(10) Patent No.: US 8,205,872 B2
(45) Date of Patent: Jun. 26, 2012

(54) SHEET SUPPLY DEVICE AND IMAGE FORMING APPARATUS

(75) Inventors: Kazumichi Yamauchi, Hachioji (JP); Kenji Yamamoto, Hachioji (JP); Hideki Nakamura, Hachioji (JP); Akira Okamoto, Hino (JP); Yoshiki Katayama, Toyokawa (JP); Kazutoshi Yoshimura, Hachioji (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 230 days.

(21) Appl. No.: 12/613,971

(22) Filed: Nov. 6, 2009

(65) Prior Publication Data

US 2010/0123281 A1 May 20, 2010

(30) Foreign Application Priority Data

Nov. 18, 2008 (JP) ..... 2008-294196

(51) Int. Cl.
*B65H 3/14* (2006.01)

(52) U.S. Cl. ..... 271/98; 271/12; 271/93; 271/112

(58) Field of Classification Search ..... 271/12, 271/93, 98, 112
See application file for complete search history.

(56) References Cited

U.S. PATENT DOCUMENTS

| | | | | |
|---|---|---|---|---|
| 4,887,805 | A * | 12/1989 | Herbert et al. | 271/94 |
| 5,344,133 | A * | 9/1994 | Jantsch et al. | 271/94 |
| 5,707,056 | A * | 1/1998 | Rauen et al. | 271/96 |
| 6,186,492 | B1 * | 2/2001 | Dechau et al. | 271/30.1 |
| 6,629,692 | B2 * | 10/2003 | Allner et al. | 271/98 |
| 7,744,081 | B2 * | 6/2010 | Ikeda | 271/98 |
| 7,770,884 | B2 * | 8/2010 | Clark et al. | 271/105 |
| 7,913,993 | B2 * | 3/2011 | Kosugi et al. | 271/98 |
| 8,002,265 | B2 * | 8/2011 | Suzuki | 271/98 |
| 2007/0228639 | A1 * | 10/2007 | Matsumoto et al. | 271/97 |
| 2007/0262513 | A1 * | 11/2007 | Fukusaka | 271/98 |
| 2008/0012202 | A1 * | 1/2008 | Hubl et al. | 271/98 |
| 2008/0237968 | A1 * | 10/2008 | Suzuki | 271/98 |
| 2009/0267288 | A1 * | 10/2009 | Sasaki et al. | 271/12 |
| 2010/0025919 | A1 * | 2/2010 | Okumura et al. | 271/12 |

FOREIGN PATENT DOCUMENTS

| | | |
|---|---|---|
| JP | 2003-171024 A | 6/2003 |
| JP | 2007-276910 A | 10/2007 |

OTHER PUBLICATIONS

Official Action issued by the Chinese Patent Office in corresponding Chinese Patent Application No. 200910211782.2, and an English-language translation of the Official Action.

* cited by examiner

*Primary Examiner* — Michael McCullough
*Assistant Examiner* — Howard Sanders
(74) *Attorney, Agent, or Firm* — Buchanan Ingersoll & Rooney PC

(57) ABSTRACT

A sheet supply device including an elevation section for up and down movement of the sheet bundle accommodated on the sheet placement table, blow sections for blowing air to the upper side surface of the sheet bundle to float up the sheet from the aforementioned sheet bundle, and a non-contact sheet detection sensor for detecting the existence or nonexistence of a sheet at the predetermined position of the aforementioned sheet placement table. The elevation drive motor is controlled in such a way as to move the sheet bundle up and down, based on the frequency or ratio of the sheet existence in the detection result of the sheet detection sensor in the operation mode of the blow section.

16 Claims, 11 Drawing Sheets

SHEET SUPPLY DEVICE AND IMAGE FORMING APPARATUS

This application is based on Japanese Patent Application No. 2008-294196 filed on Nov. 18, 2008 with Japanese Patent Office, the entire content of which is hereby incorporated by reference.

BACKGROUND OF THE INVENTION

The present invention relates to a sheet supply device and an image forming apparatus in which each sheet is separated from a bundle of sheets stacked on a sheet placement table and is supplied.

An image forming system such as a photocopier, facsimile and printer, is provided with a plurality of sheet supply units for storing sheets of paper, and the sheets stacked and stored in each of the sheet supply units are separated from one another one by one and are fed out. The sheets of paper fed out are conveyed to an image forming section, whereby images are formed on them.

Generally, a conveying apparatus equipped with a sheet supply unit of roller conveyance method is extensively used as a system of separating and conveying sheets one by one. The surface of the roller conveyance system is made of such an elastic body as a rubber characterized by high friction coefficient. Sheets are separated from one another one by one by the friction force between the sheet and the surface of the roller in contact with the sheet, and are conveyed.

In the meantime, an image forming system using electrophotographic process has come into use in the field of quick printing including POD (print on-demand) in recent years, and it is essential to meet a great variety of needs regarding the image quality and recording medium. Particularly to meet the requirements with respect to the recording medium, gloss coated paper, quality paper, printed paper or recycled paper is employed in some cases.

To improve the surface gloss, the gloss coated paper is coated with resin or the like. This enhances the level of smoothness on the surface. When such gloss coated paper is used, a required frictional force cannot be obtained between the paper and roller surface in a roller conveyance type conveyance device, and sufficient sheet supply performances cannot be ensured. Further, when printed paper is used, the paper releasing agent (powder) attached to paper is transferred to the roller surface. When recycled paper is used, powder of paper is transferred to the roller surface. In both cases, this results in reduction in frictional force, and stable and sufficient sheet supply performances cannot be ensured for a long time. This problem has been left unsolved.

One of the solutions to the aforementioned problem is proposed by an air conveyance device provided with an air conveyance type sheet supply unit (Japanese Unexamined Patent Application Publication No. 2003-171024 and Japanese Unexamined Patent Application Publication No. 2007-276910). The air conveyance device blows air from the surroundings to the top of the sheet bundle stacked and stored in the sheet supply unit so that the sheet of the topmost surface can be easily separated from others by sending air between the sheets. Then the sheet of the topmost surface is sucked by the conveyance belt, whereby sheets are conveyed one by one. The sheet is sucked by the conveyance belt by means of the pressure difference of the air blow produced by the rotation drive of the suction fan. Such an air conveyance device is so structured as to meet the requirements of a great variety of recording media.

To ensure that the sheet of the topmost surface of the sheet bundle stored in the sheet supply unit is sucked by the conveyance belt and is conveyed, the distance from the conveyance belt must be kept within a predetermined range by detecting the position of the topmost surface of the sheet bundle and raising the elevating stand carrying the sheet bundle in conformity to the detected value.

In this proposed method, the position of the top surface of the sheet bundle is detected by the top surface detecting section of the sheet bundle wherein a contact member is brought in contact with the top surface of the sheet bundle, and the movement of the contact member displaced in conformity to a change in the position of the top surface of the sheet bundle is read by an optical sensor.

However, in the air conveyance device disclosed in the Japanese Unexamined Patent Application Publication No. 2003-171024 and Japanese Unexamined Patent Application Publication No. 2007-276910, the top surface is detected by the detecting section that employs a contact member. This arrangement brings the contact member in contact with the sheet bundle. This may damage the sheet when a delicate sheet such as thin paper or computer output sheet is used. Further, in the air conveyance type sheet supply unit, air must be blown to the top surface of the sheet bundle to separate or isolate sheets. The air blow may be interfered by the contact member, with the result that sheets cannot be separated or sorted out.

To solve such a problem, a non-contact sensor could be used to detect the top surface of the sheet bundle. However, during the sheet supply, a plurality of sheets are floated at different positions on the top portion of the sheet bundle by the air blow for the purpose of separation or sorting of sheets. This leads to a failure in the accurate detection of the uppermost point of the sheet bundle in the non-floated state. The uppermost point of the non-floated sheet bundle cannot be maintained at the predetermined position (height). Such problems have been left unsolved in the conventional art.

In view of the prior art problems described above, it is an object of the present invention to provide a sheet supply device in which the uppermost point of the non-floated sheet bundle is always kept at a predetermined position during the sheet supply, without the internally stored sheets being damaged, although the aforementioned apparatus is an air conveyance type sheet supply device.

SUMMARY

To achieve at least one of the aforementioned objects, the sheet supply device and image forming apparatus reflecting one aspect of the present invention includes as follows.

1. A sheet supply device including a sheet placement table for storing a plurality of sheets as a sheet bundle, an elevation section for raising and lowering the sheet bundle stored in the sheet placement table, a blow section for floating a sheet up from the sheet bundle by blowing air to a side surface of the sheet bundle, a sheet conveyance section which applies suction to the sheet which has been floated by air blown by the blow section and conveys the sheet which has been absorbed by the suction one by one in a conveyance direction, a sheet detection sensor provided at a predetermined position of the device so as to detect existence or nonexistence of the sheet at the predetermined position without contact with the sheet and a control section for controlling the elevation section so as to raise the sheet bundle during an operation of the blow section when a state of the sheet at the predetermined position is determined to be a floating state based on a result of the detection of the sheet detection sensor.

2. The image forming apparatus including the sheet supply device of the item 1, and an image forming section for forming an image on the sheet conveyed from the sheet supply device.

DETAILED DESCRIPTION OF THE PREFERRED EMBODIMENTS

The present invention will be described based on preferred embodiments without the present invention being limited to the embodiments.

[Image Forming Apparatus]

Figure 1:
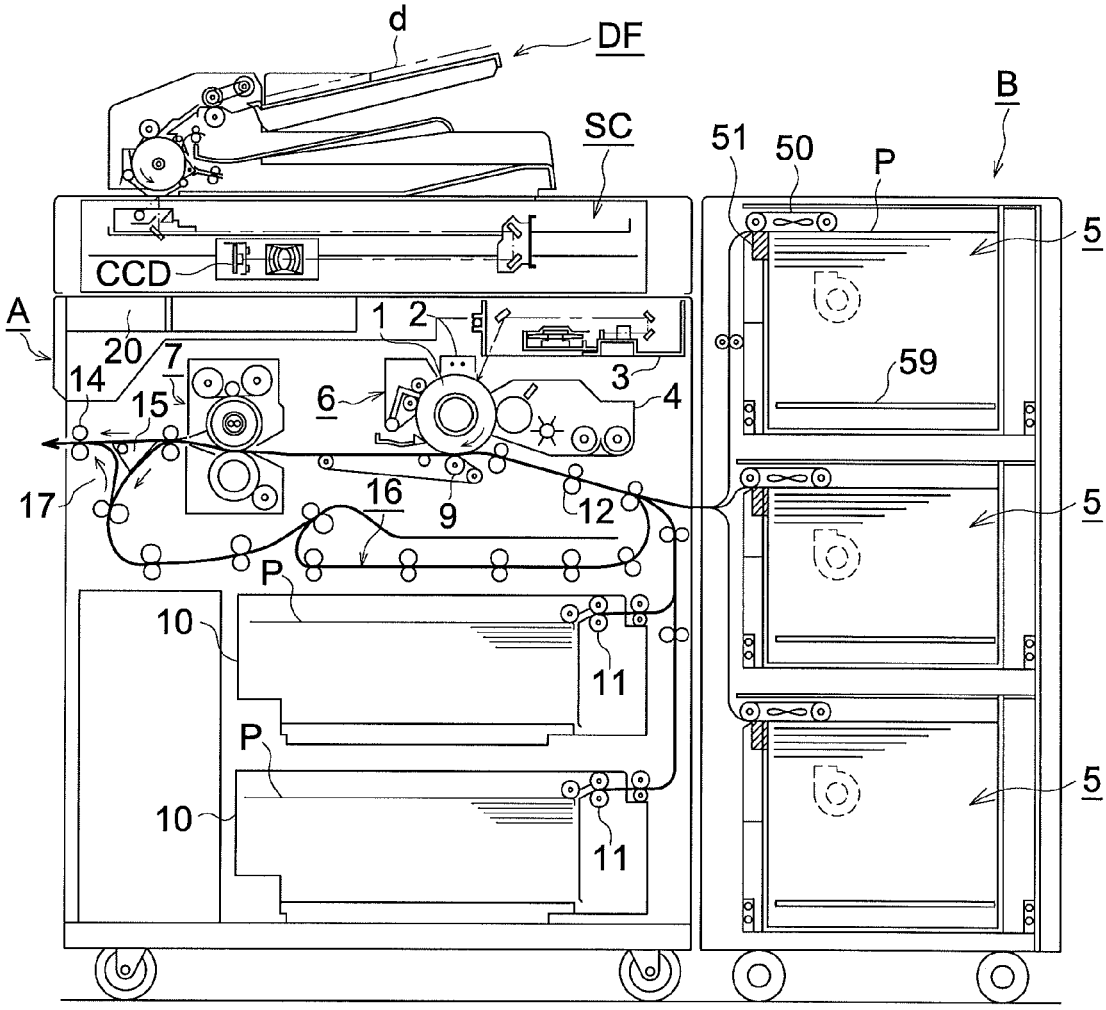
FIG. 1 is a diagram representing an overall schematic diagram of an image forming apparatus of an embodiment of the present application.

FIG. 1 is an overall structural diagram of an image forming apparatus related to an embodiment. The image forming apparatus is configured with an image forming apparatus body A, an image reading apparatus SC, an automatic document feeding apparatus DF, and a sheet supply device B.

The image forming apparatus body A in the figure is configured with an "image forming section" equipped with a photoconductive body (image carrier) 1, a charging device 2, an image exposing device 3, a developing device 4, a transfer device 9, a cleaning device 6 and so forth, and further configured with a fixing device 7 and a sheet conveyance system.

The sheet conveyance system is configured with a sheet feeding unit 10, a first sheet feeding device 11, a second sheet feeding device 12, paired sheet ejection rollers 14, a conveyance path changeover device 15, a duplex conveyance path 16 and a reversal sheet ejection path 17.

The document "d" placed on a document table of the automatic document feeding apparatus Df is conveyed through a sheet feeding device, an image or images on one side or both sides of the document "d" is read by an optical system of the image reading apparatus SC, and the image is acquired by an image sensor CCD. An analogue signal generated through photoelectric conversion by the image sensor CCD is subject to processes such as an analogue process, A/D conversion, shading correction, and image compression, then an image signal is sent to the image exposing device 3.

In the image forming device, processes such as charging, exposing, developing, transferring, separating and cleaning are performed.

In the image forming device, the charging device 2 provides the photo conductive body 1 with a charge (a negative charge in the present embodiment), an electrostatic latent image is formed by a laser beam radiation from the image exposing device 3, and a toner image (in the present embodiment, the toner carries a negative charge) is formed by visualizing the electrostatic latent image through the developing device 4. Next, a sheet P stored in the sheet feeding unit 10 is conveyed from the first sheet feeding device 11. On the other hand, the cleaning device 6 removes residual toner of transfer from the photoconductive body 1.

The sheet P, synchronized with the toner image by the second sheet feeding device 12 configures with a regulation roller, is conveyed. Thereafter, the toner image is transferred on the sheet through the transfer device 9 and fixed by the fixing device 7. The sheet P after fixing is ejected outside the apparatus through paired sheet ejection rollers 14.

Meanwhile, in case of duplex copy, the sheet P having an image formed on the first surface thereof is sent to the duplex conveyance path 16 to be reversed, then after image forming on the second surface by the image forming device again, the sheet is ejected outside the apparatus through the paired sheet ejection rollers 14. In case of reverse sheet ejection, the sheet P diverges from an ordinary ejection path and is turned over by a switchback through the sheet reversal ejection path 17 and then ejected outside the apparatus through the paired sheet ejection rollers 14.

[Sheet Supply Device B]

The sheet supply device B connected to an image forming apparatus body A includes a plurality of air conveyance type sheet supply units 5. Each of the sheet supply units 5 includes a sheet absorbing conveyance device 50 working as a "sheet conveyance section", a sheet detection sensor 51, and a sheet placement table 59. Each sheet supply unit 5 accommodates a great number of sheets P and conveys sheets P one by one to the image forming apparatus body A. In the example of FIG. 1, the sheet supply units 5 are designed in three levels. Each sheet supply unit 5 is capable of storing 1500 through 2500 sheets. Further, each sheet supply unit 5 can be drawn out of the sheet supply device B by means of the guide rails 590 on the right and left.

Figure 2:
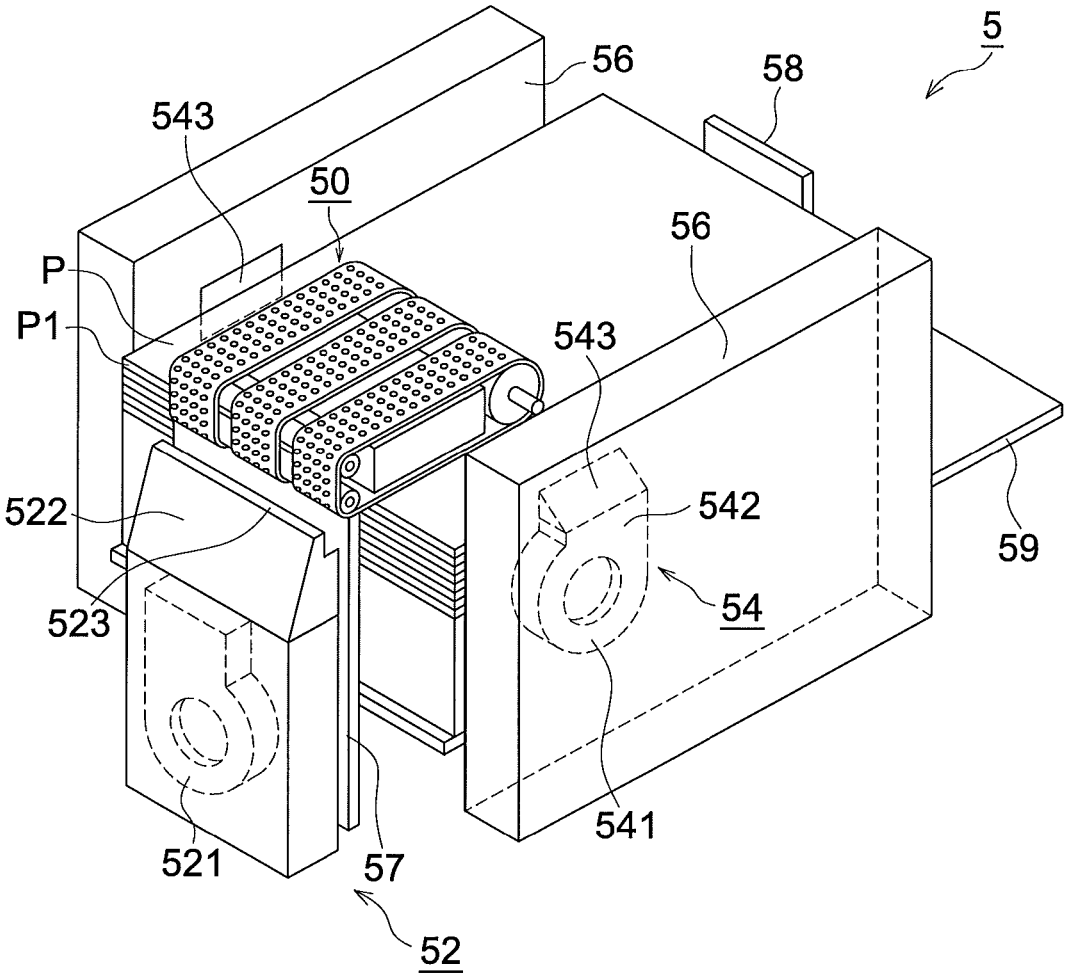
FIG. 2 is a perspective view representing the major portions of a sheet supply unit 5 of the present embodiment.
Figure 3:
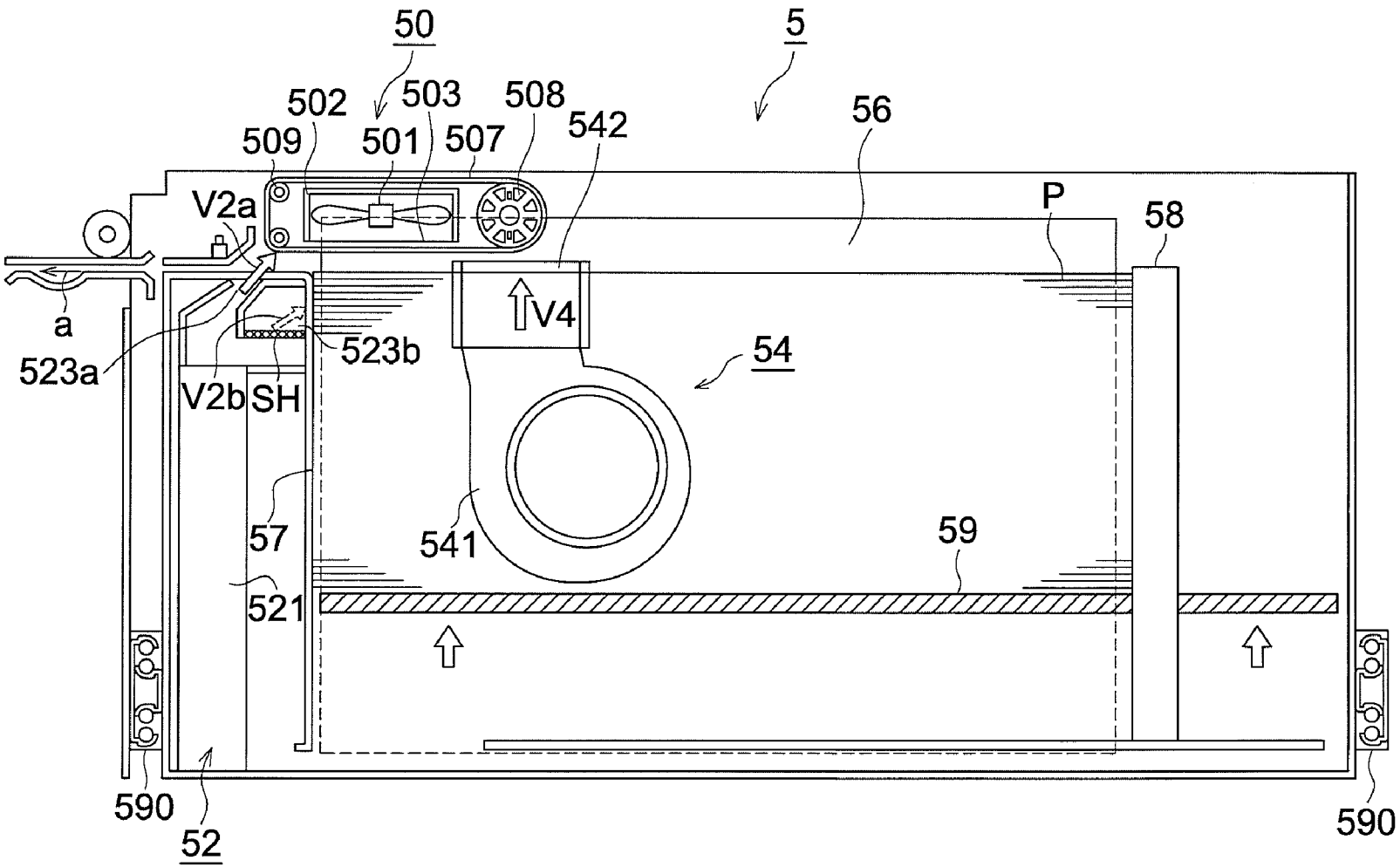
FIG. 3 is a front cross sectional view of the sheet supply unit 5.
Figure 4:
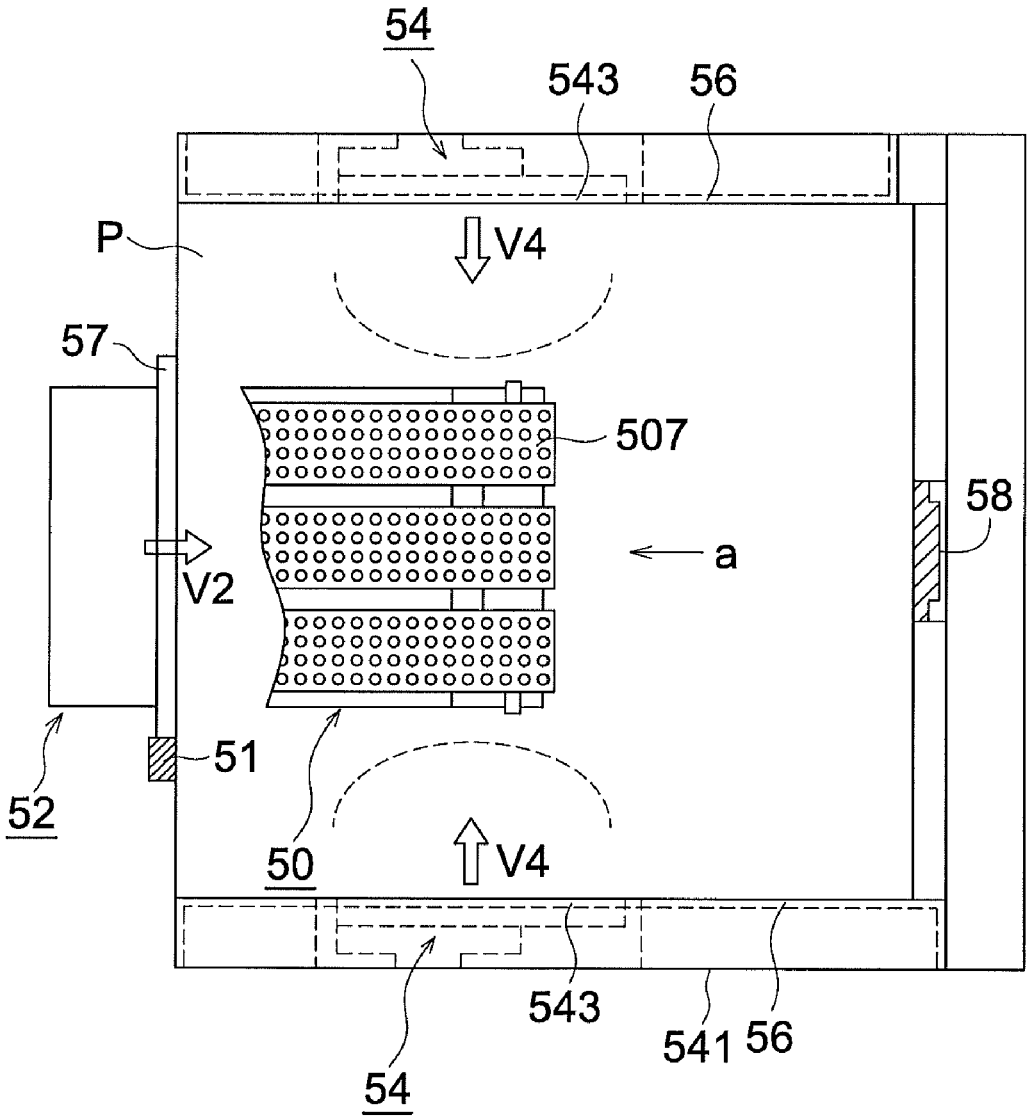
FIG. 4 is a plan view of the sheet supply unit 5.
Figure 5:
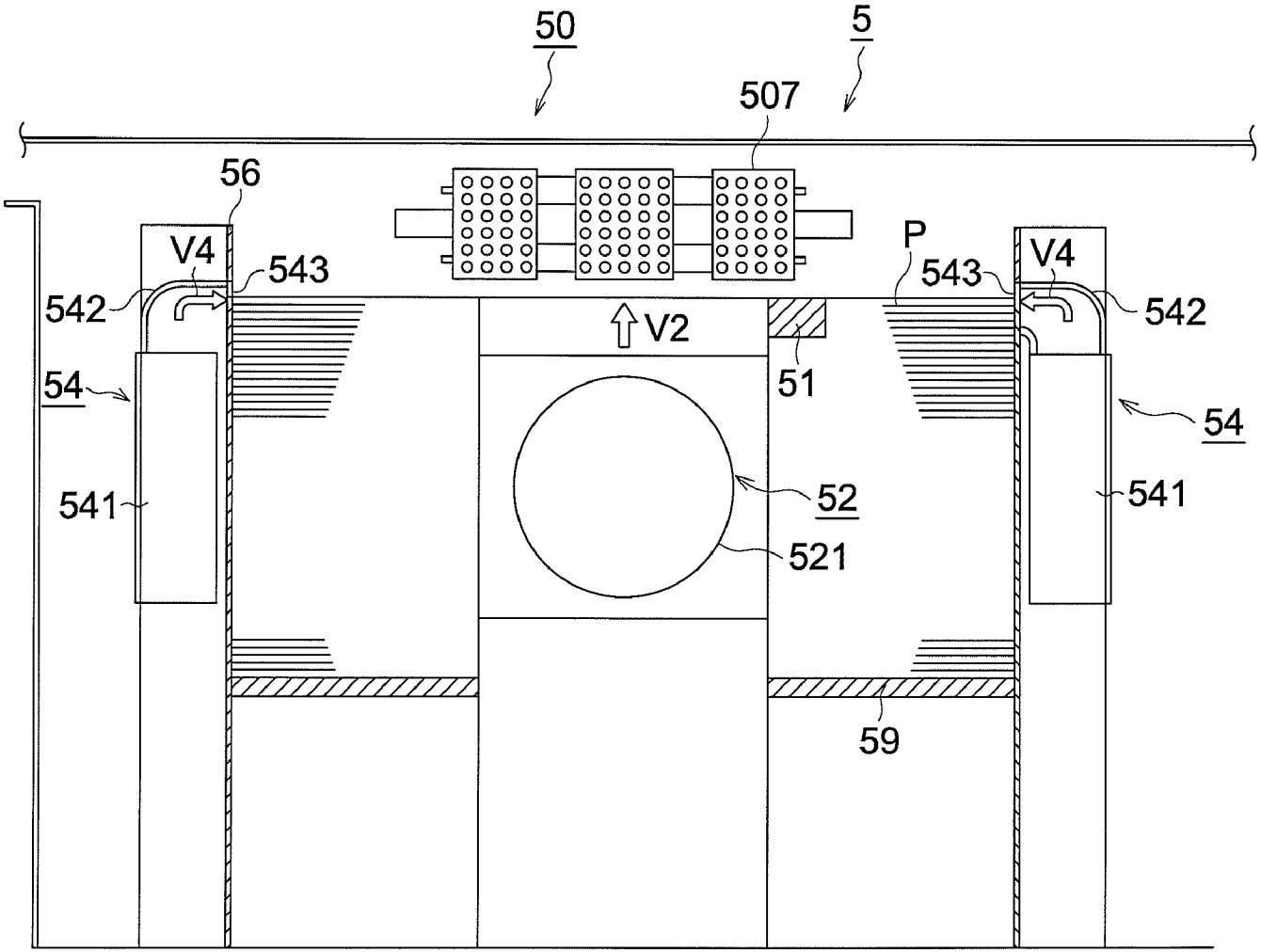
FIG. 5 is a side view of the sheet supply unit 5.

The following describes the structure of the sheet supply unit 5 of the sheet supply device B with reference to FIGS. 2 through 5. FIG. 2 is a perspective view representing the major portions of the sheet supply unit 5 of the present embodiment. FIG. 3 is a front cross sectional view of the sheet supply unit 5. FIG. 4 is a plan view of the sheet supply unit 5. FIG. 5 is a side view of the sheet supply unit 5 of FIG. 1, as observed from the left.

The sheet supply device B ensures that the stored A4-sized sheets, for example, are conveyed to the image forming apparatus body A at the maximum speed of 120 sheets P per minute. The sheets P stored in each sheet supply unit 5 are placed on a sheet placement table 59 as a sheet bundle, and are stored so that the sheets P can be moved up and down by the elevation drive motor B7 (illustrated in FIG. 7) acting as an "elevation section". Further, a pair of sheet lateral end regulating plates 56 regulate the sheet bundle Pb by coming in contact with the lateral end of the stacked sheet bundle across the width perpendicular to the direction of the sheet P being conveyed (hereinafter referred to as "across the width" for short). The relative distance between two sheet lateral end regulating plates 56 can be changed as desired, and the position of the sheet bundle Pb across the width is determined in conformity to sheet size. Further, the sheet lateral end regulating plate 56 is designed in a box type structure having a sufficient length in the sheet feed direction and a high degree of rigidity.

The sheet leading edge regulating plate 57 regulates the leading edge of the stacked sheet bundle in the sheet conveyance direction and is fixed to the sheet supply unit 5 in position.

The sheet trailing edge regulating plate 58 is freely movable along the length of the sheet P, and regulates the position of the trailing edge (upstream in conveyance direction) in the direction of feeding the sheet P. The sheet trailing edge regulating plate 58 is supported by the sheet supply unit 5 in such a way as to be displaced in the sheet conveyance direction.

Further, the sheet lateral end regulating plate 56 and sheet trailing edge regulating plate 58 are designed to have such a height and shape as to constantly regulate the sheet P floated up by air (to be described later).

[Sheet Absorbing Conveyance Device 50]

As shown in FIG. 3, a sheet absorbing conveyance device 50 is arranged on the downstream side in the direction of conveying the sheets from the sheet bundle stacked on the sheet placement table 59. Three absorbing conveyance belt 507 that is applied to a large-diameter roller 508 and two small-diameter rollers 509 and is driven thereby are arranged in parallel across the width on the sheet absorbing conveyance device 50, wherein these rollers are connected with a conveyance drive motor (not illustrated).

As shown in FIG. 2 and others, the absorbing conveyance belt 507 is provided with a great number of small through holes. A duct 502 is fixed inside the absorbing conveyance belt 507.

The duct 502 and suction fan 501 connected to the same act as a "sucking section". The lower portion of the duct 502 is provided with a suction port 503 opposed to each absorbing conveyance belt 507. The suction port 503 determines the position of sucking air for the sheet absorbing conveyance device 50. The sucked air is ejected toward the inner portion through the duct 502. It is also possible to arrange another embodiment in such a way that the suction fan 501 is provided on the inner portion of the sheet supply unit 5, and is connected with the sheet absorbing conveyance device 50 via the duct.

The suction fan 501 is always operating, and the sheet absorbing conveyance device 50 ensures that the sheet P at the uppermost point floated up by the sheet isolation mechanism for air blowing (to be described later) is absorbed by the absorbing conveyance belt 507. After the sheet has been absorbed by control of the control section (to be described later), the drive source is operated at a predetermined time interval and the absorbing conveyance belt 507 is rotated. Then the absorbed sheet P is conveyed in the direction of arrow "a" (downstream in the sheet conveyance direction), and is fed into the image forming apparatus body A.

[Floating Separation from the Sheet Bundle •• Air Isolation of Sheets]

The following describes the "floating separation process". In the floating separation process, air is blown to the upper side surface of the sheet bundle stacked on the sheet placement table 59, and air is fed into between the sheet bundle and the sheet P above the sheet bundle so that sheet P is separated from one another. The upper side surface of the sheet bundle in the sense in which it is used here refers to the side surface on the side to which sheets are conveyed one by one, of the sheet bundle stacked on the sheet placement table 59.

As shown in FIGS. 2 through 5, the side blow section 54 for blowing air to the top of the sheet bundle Pb stacked in the sheet placement table 59 from across the width and leading edge blow section 52 are arranged on both sides of the sheet placement table 59 and downstream in the sheet conveyance direction. It should be noted that the leading edge blow section 52 and side blow section 54 serve as a "blow section".

The "side blow section 54" is arranged on the sheet lateral end regulating plate 56, and includes a blower fan 541 and a duct 542. Air is blown to the top of the sheet bundle from the air blow port 543 arranged on the sheet lateral end regulating plate 56. Having a blow outlet facing upward, the blower fan 541 is mounted on the sheet lateral end regulating plate 56. The air ejected upward is turned 90 degrees by the duct 542, and is blown in the horizontal direction from the air blow port 543 of the sheet lateral end regulating plate 56 (blow air V4).

Preferably, the height of the air blow port 543 is such that the sheet P1 on the uppermost layer is located approximately at the center of the air blow port 543. The height of the air blow port 543 is set to an appropriate level in conformity to the capacity of the blower fan 541 or the designing requirements of the duct 542 and others.

As described above, the air blow port 543 and side blow section 54 are mounted on the sheet lateral end regulating plate 56, and can be moved as an integral structure. Thus, a predetermined positional relation to the sheet bundle Pb can be maintained constantly in conformity to the changing sheet size.

The "leading edge blow section 52" includes a blower fan 521 and duct 522. Air can be blown from the air blow port 523*a* or air blow port 523*b*.

When air is blown from the air blow port 523*b* having an opening in the horizontal direction, this air blow port 523*b* is capable of blowing air to the top of the stacked sheet bundle Pb in the horizontal direction (blow air V2*b*). When air is blown from the air blow port 523*a* having an opening in the upward direction, the air blown upward is emitted from the air blow port 523*a* diagonally above (blow air V2*a*). As shown in FIG. 3, the air blown out of the air blow port 523*a* is blown obliquely with respect to absorbing conveyance belt of the sheet absorbing conveyance device 50 from the downstream side of the sheet conveyance direction. When a plurality of sheets P are absorbed on the absorbing conveyance belt 507 by this air blow, these sheets P are isolated as described below.

[Absorption, Isolating and Conveyance of Sheets]

The leading edge blow section 52 controls the air blowing force in response to the type of the sheet P. To be more specific, for the OHP film, tracing sheet, enamel paper having a smooth surface, perforated or streaked sheets, and offset-printed sheet coated with powder as well, air is blown between the sheets of the sheet bundle to ensure separation of sheets.

Figure 6A:
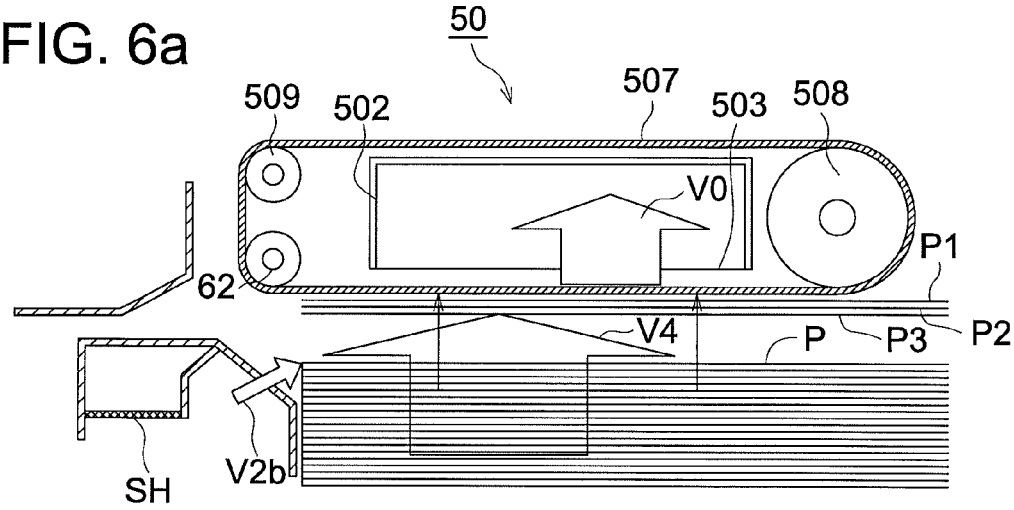
FIGS. 6*a*, 6*b* and 6*c* are explanatory diagrams showing the process wherein sheets P1, P2 and P3 having been separated from the sheet bundle Pb by a side blow section 54 and leading edge blow section 52 is sucked and conveyed by a sheet absorbing conveyance device 50.
Figure 6B:
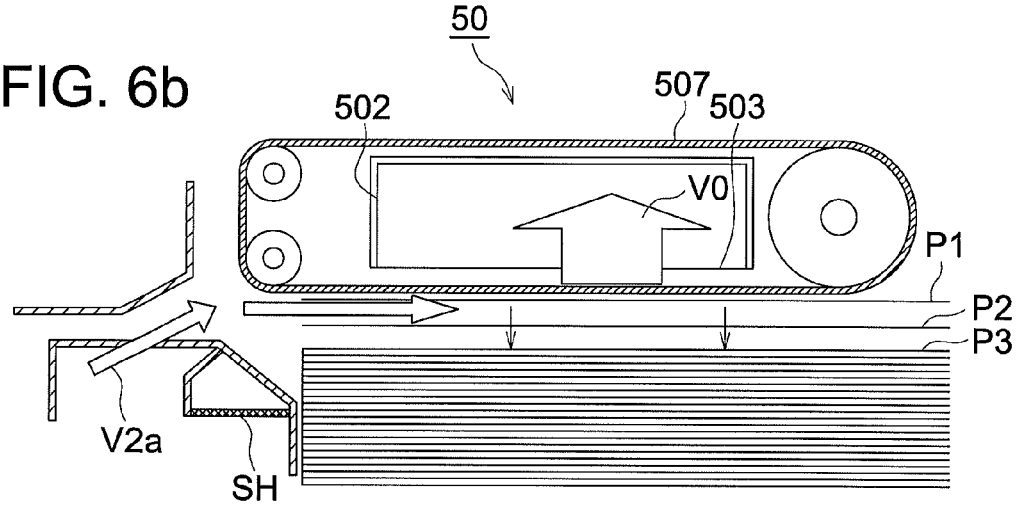
Figure 6C:
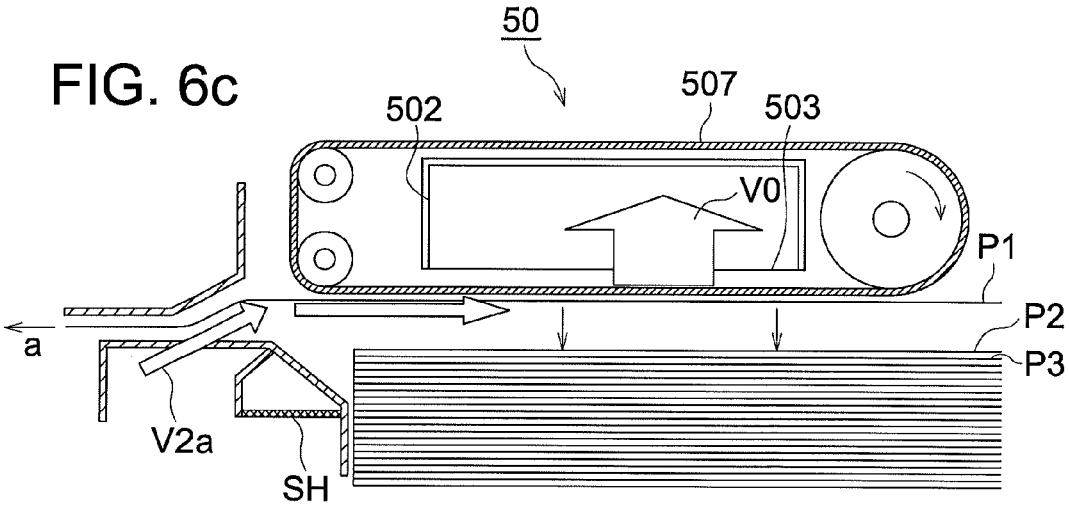

FIGS. 6*a*, 6*b* and 6*c* show the process wherein the sheets P1, P2 and P3 having been separated from the sheet bundle Pb by the side blow section 54 and leading edge blow section 52 are absorbed by the sheet absorbing conveyance device 50, and are conveyed.

FIG. 6*a* shows the "sheet absorption process". The sheets P1, P2 and P3 are separated from the sheet bundle Pb and are floated up by the side blow section 54 and leading edge blow section 52, and the sheet P1 at the uppermost point is absorbed by the sheet absorbing conveyance device 50. A small number of sheets P on the upper layer of the sheet bundle stacked on the sheet placement table 59 are lifted against the own weight of the sheets by the blow air V4 blown by the side blow section 54 and the blow air V2*b* blown by the leading edge blow section 52. In this case, only the sheet P1 at the uppermost point is absorbed onto the absorbing conveyance belt by the intake air V0 resulting from the negative pressure of the absorbing conveyance belt 507. It should be noted that, in this case, the shutter SH of the leading edge blow section 52 has been shifted to the left, as shown in FIG. 6*a*, and therefore, air can be blown from the air blow port 523*b*.

In the sheet supply unit 5 of the present embodiment, the sheet P1 at the uppermost point floated up by the side blow section 54 is absorbed at a desired position of the sheet absorbing conveyance device 50 in the state indicated by a solid line of FIG. 6*a*, as described above. Thus, the suction port 503 is completely screened by the sheet P1 of the uppermost point, and therefore, the sheets P2 and P3 below are not subjected to the effect of the intake air V0 of the sheet absorbing conveyance device 50.

FIG. 6*b* shows the "sheet sorting process" wherein other sheets (P2, P3) are isolated out from the sheet P1 by the leading edge blow section 52. The sheets P2 and P3 are not affected by the intake air V0 of the absorbing conveyance belt 507. Between the sheet P2 and sheet P1 (also between the sheet P3 and sheet P2), the sheets such as sheet P2 located below the sheet P1 are completely separated from the sheet 1 by the blow air V2*a* blown by the leading edge blow section 52. In this case, the shutter SH of the leading edge blow section 52 is shifted to the right, as shown in FIG. 6*b*, and therefore, air can be blown from the air blow port 523*a*.

FIG. 6*c* shows the "sheet conveyance process" performed by the sheet absorbing conveyance device 50. When the conveyance drive motor is operated, the large-diameter roller 508 and absorbing conveyance belt 507 wound by the same are driven to rotate (in the clockwise direction as illustrated). When the absorbing conveyance belt has been driven, the sheet P1 absorbed by the absorbing conveyance belt 507 is conveyed in the direction of arrow "a".

As described above, the sheet supply device of the present invention ensures excellent performances in feeding a wide range of sheets from smooth paper to plain paper in a wide variety of environments including high-humidity environment, free from a feed error such as multiple feed or failure of feed.

[Sheet Detection Sensor 51 •• the Uppermost Point Detecting Section for Sheet Bundle]

Further, the sheet leading edge regulating plate 57 is provided with a sheet detection sensor 51 for detecting the uppermost point of the sheet bundle stacked on the sheet placement table 59, as shown in FIGS. 4 and 5.

Figure 8:
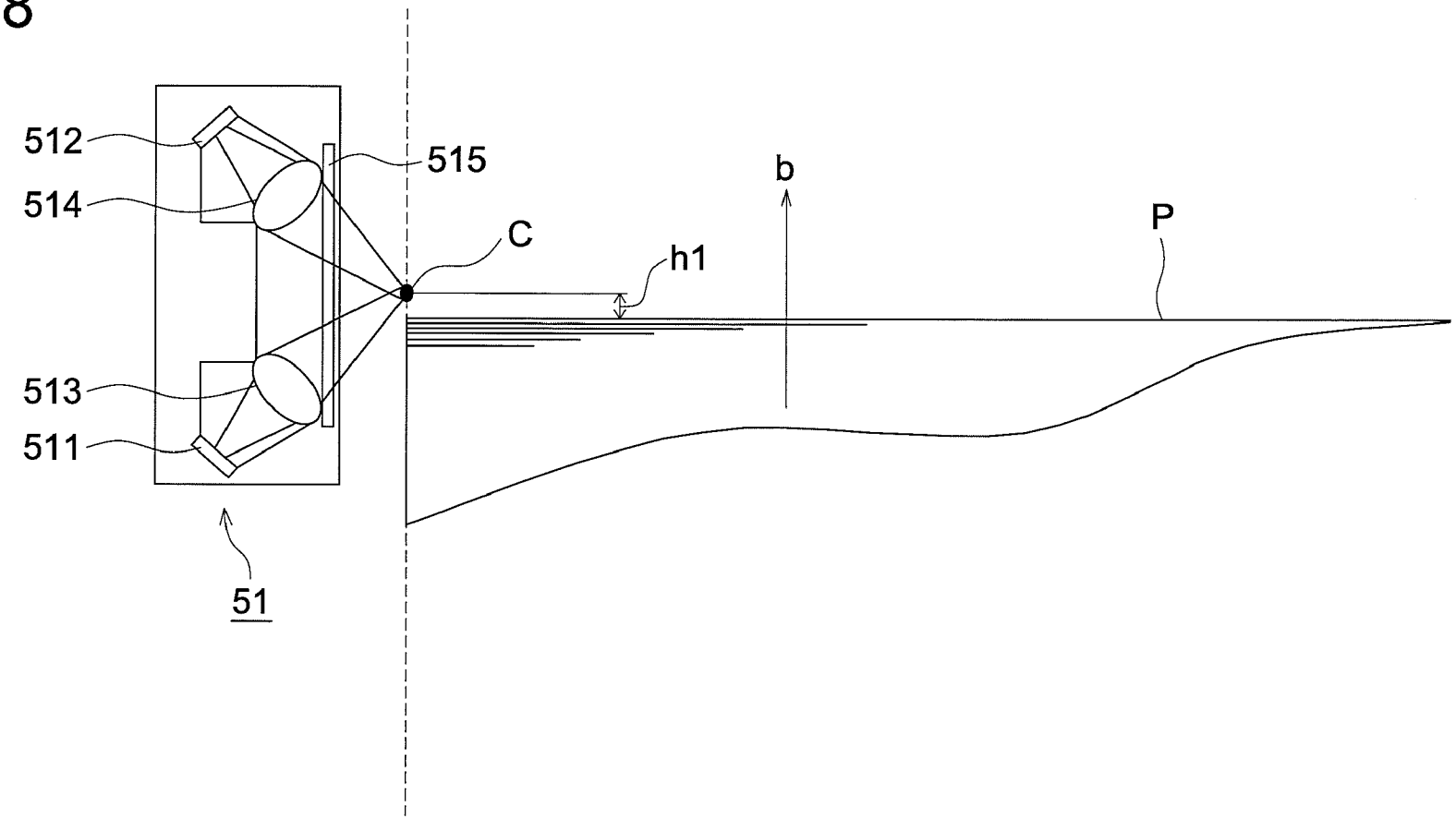
FIG. 8 is an explanatory diagram representing the structure of a sheet detection sensor 51 and the predetermined position.

FIG. 8 is an enlarged view of the sheet detection sensor 51.

The sheet detection sensor 51 is a non-contact optical sensor, and includes a light emitting section 511, a light receiving section 512 for converting the received light into an electric signal, and a lens section composed of a first lens 513 and a second lens 514. The light emitted from the light emitting section 511 is converged by the first lens 513 onto the predetermined position C of the moving surface where the end of the sheet bundle Pb is moved up and down. The secondary light reflected on the sheet (sheet bundle) at a predetermined position C is converged onto the light receiving section 512 by the second lens 514. The lens section is protected by a dust-proof glass 515. The predetermined position C is the position (height) where the uppermost point of the sheet bundle is kept at an appropriate distance from the absorbing conveyance belt 507. To be more specific, the predetermined position C is not the place where multiple feed is caused by excessive approach to the absorbing conveyance belt 507, or sheet supply performance is adversely affected by excessive sheet supply intervals resulting from excessive distance from the approach to the absorbing conveyance belt 507.

Thus, the sheet detection sensor 51 provided with the first and second lenses ensures high-precision detection of the existence or nonexistence of a sheet at the predetermined position C of the sheet supply unit 5. To put it another way, the sheet detection sensor 51 ensures high-precision optical detection of whether or not the uppermost point of the sheet bundle traveling up and down is located at the predetermined position C, based on the detection signal of the sheet detection sensor 51.

In FIG. 8, the aforementioned predetermined position C is higher by "h1" than the uppermost point of the sheet bundle Pb, as illustrated.

Before the sheet supply operation starts, control is provided so that the sheet bundle Pb on the sheet placement table 59 is moved upward in the direction of arrow "b" until the signal of the sheet detection sensor 51 changes from sheet non-existence to sheet existence. This allows the uppermost point of the sheet bundle Pb to be set to the predetermined position C (the most appropriate height). For example, control is provided so that the elevation drive motor B7 (shown in FIG. 7) is driven or stopped, based on the result of detection by the sheet detection sensor 51 shown in FIG. 4 and FIG. 5.

Further, the upper position of the sheet bundle is detected in the non-contact manner. This prevents the sheet from being damaged or streaked even when a delicate sheet such as thin paper or business format sheet is used.

[Determining the Uppermost Point of the Non-Floating Sheet Bundle Based on the Result of Detection by the Sheet Detection Sensor 51]

Figure 9A:
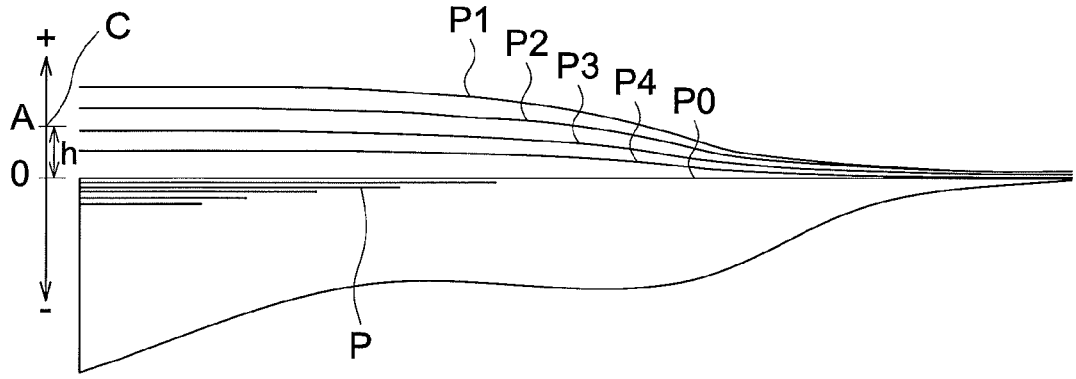
FIGS. 9*a*, 9*b* and 9*c* are the explanatory diagrams showing the result (signals) of detection by a sheet detection sensor 51, and the relationship between the detection ratio of "sheet existence" obtained in conformity to the result of detection and the predetermined position.

FIG. 9*a* shows that, during the sheet supply operation, the sheets P1, P2, P3 and P4 out of the sheets of the sheet bundle Pb are floated up by the air from the "blow section" composed of a leading edge blow section 52 and side blow section 54. The floated sheets P1, P2, P3 and P4 exhibit unstable behavior wherein the sheets are occupying various positions temporarily in relation to the sheet absorbing conveyance device 50. Thus, during the operation of the blow section, if control is performed to raise the sheet bundle based on the existence or nonexistence of a sheet according to the detection signal of the sheet detection sensor 51 like when the sheet is not supplied, the uppermost point P0 of the non-floating paper of the sheet bundle Pb cannot be easily maintained at the predetermined position (height) of the sheet supply unit 5 stably. Then the uppermost point of the non-floating sheet bundle will be too close to the sheet absorbing conveyance device 50. This will increase the frequency of the multiple sheet feed being performed. Or conversely, the distance of the sheets from the sheet absorbing conveyance device 50 will be excessively increased and the interval of the sheets to be absorbed by the sheet absorbing conveyance device 50 will be increased. This will cause the sheet supply performance to be adversely affected. This is the problem with the sheet bundle elevation control using a conventional non-contact sensor.

To be more specific, "to maintain the uppermost point of the non-floating sheet bundle constantly at the predetermined position (height) of the sheet supply unit 5 on a stable basis" is an important factor in the sheet bundle elevation control using a non-contact sensor. The following describes the embodiment for the solution of the problems.

Figure 9B:
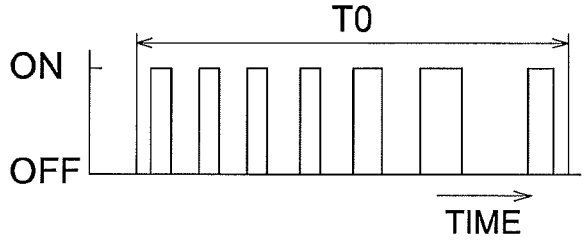

FIG. 9*b* shows a detection signal of the sheet detection sensor 51 when the predetermined position C of the sheet detection sensor 51 is located at the point A of FIG. 9*a*. Time is plotted on the horizontal axis. The "ON" plotted on the vertical axis indicates a signal showing that the sheet detection sensor 51 has detected the "sheet existence". The "OFF"

indicates a signal showing that the sheet detection sensor 51 has detected the "sheet nonexistence".

The sheet detection sensor 51 used in this case is adjusted in advance in such a way that the "sheet existence" signal is issued when the amount of light entering the light receiving section 512 has exceeded a reference level, and the "sheet nonexistence" signal is issued when the amount of light entering the light receiving section 512 is below the reference level.

In FIG. 9*a*, "h" denotes the boundary between the non-floating and floating sheets, namely, the distance between sheet P0 at the uppermost point of the non-floating sheet bundle, and the predetermined position C of the sheet detection sensor 51. When the predetermined position C is located above the uppermost point sheet P0, the direction is positive. When the predetermined position C is located below the uppermost point sheet P0, the direction is negative. "0" is used to indicate the case wherein the predetermined position C is located at the uppermost point sheet P0.

When "h" is in the positive direction, the detection ratio of "sheet existence" is reduced. Conversely, if "h" moves in the negative direction, the detection ratio of "sheet existence" is increased. If "h" moves to a still lower position, the detection ratio of the sheet existence reaches 100%.

Figure 9C:
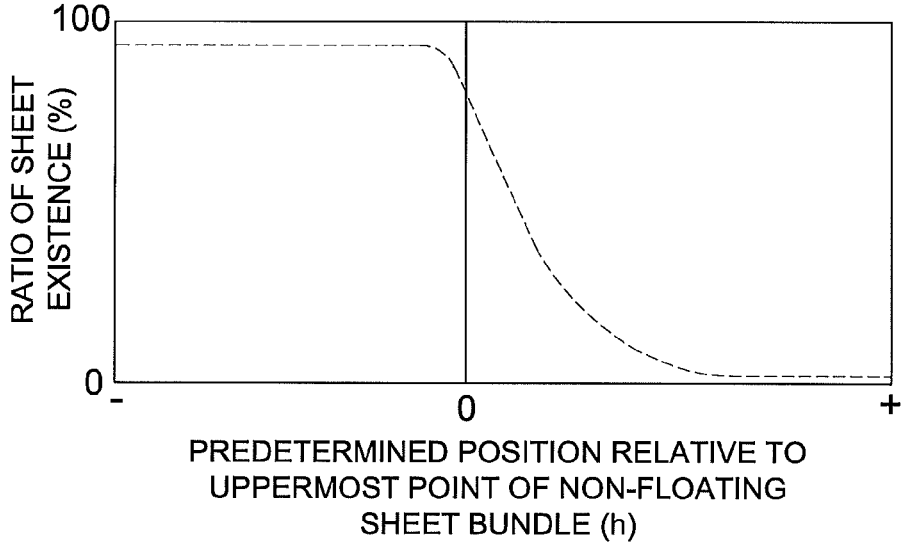

FIG. 9*c* indicates the aforementioned relationship. In actual practice, however the illustrated characteristic curve exhibits various changes with reference to the actual uppermost point of the non-floating sheet bundle, depending on the target area of the predetermined position (height) (detection resolution of the sheet detection sensor 51) or the reference value for detecting the "sheet existence" using the sheet detection sensor 51.

For the aforementioned reasons, the detection ratio (%) with respect to the uppermost point P0 of the non-floating sheet bundle is set to an appropriate level in conformity to the properties of the sheet detection sensor 51. Further, in view of the actual sheet supply mechanism, it is sufficient that the uppermost point P0 of the non-floating sheet bundle can be maintained at the position (height) within a predetermined range.

If the conventional "sheet bundle elevation control based on the detection of sheet existence" is converted to the "sheet bundle elevation control based on the detection ratio of sheet existence", the "uppermost portion of the non-floating sheet bundle" can be maintained at the "position within a predetermined range" at all times. This solves the aforementioned problems of the sheet bundle elevation control using a non-contact sensor.

[Control Block]

Figure 7:
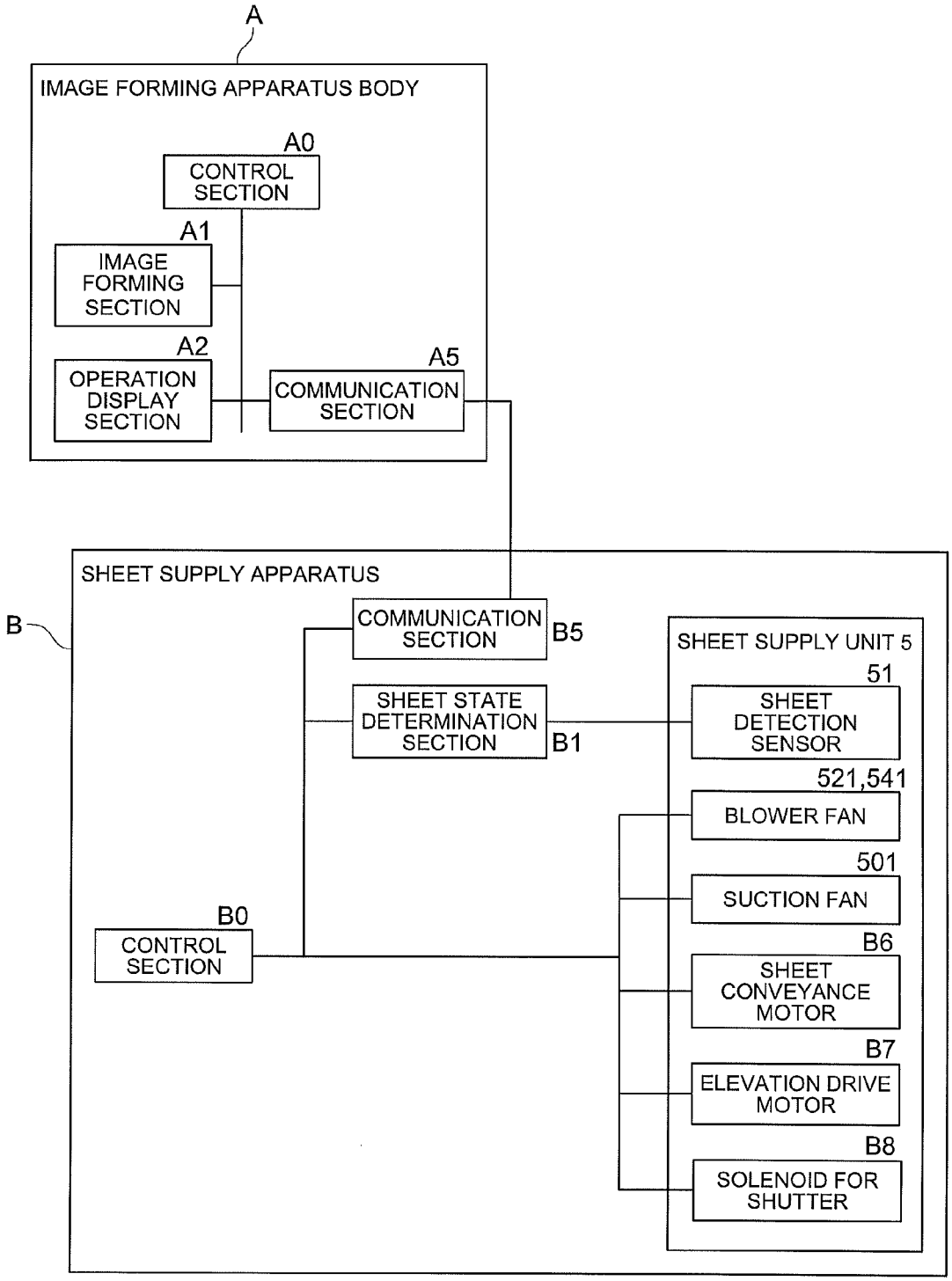
FIG. 7 is a control block diagram showing an image forming apparatus.

FIG. 7 is a control block diagram of the image forming apparatus. FIG. 7 mainly illustrates the portion and the periphery required for the description of the operations in the present embodiment. Other known portions of the image forming apparatus will not be described.

The B0 indicates a controlling section which serves as a "control section". The control section B0 includes a CPU, ROM and RAM. The CPU reads a predetermined program stored in the ROM, and this program is developed on the work area of the RAM. Various processing is performed in conformity to the program developed on the RAM.

The sheet supply unit 5 includes a sheet detection sensor 51, blower fans 521 and 541, suction fan 501, sheet conveyance motor B6, elevation drive motor B7 and solenoid for shutter B8.

The control section B0 communicates with the control section A0 of the image forming apparatus via the communication section B5 of the sheet supply device B and communication section A5 of the image forming apparatus body A. The image forming apparatus body A allows the sheet information on the accommodated sheets S in each sheet supply unit 10 of the image forming apparatus body A and each sheet supply unit 5 of the sheet supply device B to be inputted through the operation display section A2. The sheet information includes the information on the type of paper such as plain paper or enamel paper, information on the basis weight of the sheet, and information on sizes. The control section B0 of the sheet supply device B can obtain the information on sheet type through the communication section B5.

The sheet detection sensor 51 of the sheet supply unit 5 permits the result of detection to be outputted to the sheet state determination section B1. Based on the result of detection by the sheet detection sensor 51, the sheet state determination section B1 determines the state of the sheet at the predetermined position of the sheet detection sensor 51. To put it more specifically, the sheet state determination section B1 determines the "sheet nonexistence state", "floating sheet existence state, namely, floating state of sheet" or "non-floating state of sheet bundle".

The state of the sheet is detected according to the ON/OFF output of the sheet detection sensor 51 within a predetermined time T0 shown in FIG. 9*b*. If the cumulative time of ON output within a predetermined time T0 is assumed as T1, "detection ratio of sheet existence" R is T1/T0. If the "detection ratio of sheet existence" R is below a predetermined value R1, the state is determined as "sheet nonexistence state". If the "detection ratio of sheet existence" R is R1 or more and less than R2, the state is determined as "floating state of sheet". If the "detection ratio of sheet existence" R is a predetermined value R2 or more, the state is determined as "non-floating state of sheet bundle".

The state of the sheet of the sheet bundle Pb can also be determined by the frequency of the ON/OFF switching of the sheet detection sensor 51 (number of switching operations within a predetermined time period). For example, if the ON/OFF switching frequency F is below than a predetermined value F1, the state is determined as "sheet nonexistence state". If the ON/OFF switching frequency F is F1 or more and less than F2, the state is determined as "floating state of sheet". If the ON/OFF switching frequency F is a predetermined value F2 or more, the state is determined as "non-floating state of sheet bundle".

When the sheet state determination section B1 has determined the "sheet nonexistence state" or "floating state of sheet", the control section B0 drives the elevation drive motor B7 by a predetermined amount in the direction where the sheet bundle moves upward. If the "sheet nonexistence state" has been determined, the aforementioned predetermined amount can be increased over the amount in the case of "floating state of sheet".

When the sheet state determination section B1 has determined "non-floating state of sheet bundle" after driving a predetermined amount, the control section B0 keeps the elevation drive motor B7 at the suspension mode to ensure that the position of the sheet bundle can be maintained.

The drive mechanism between the elevation drive motor 37 and sheet bundle elevation section is structured as follows. When the elevation drive motor B7 is driven, the sheet bundle is moved up and down. When the drive of the elevation drive motor B7 has been suspended, the sheet bundle is held at the current position.

In the aforementioned embodiment, the sheet state determination section B1 is a composition separate from the control section B0. However, the sheet state determination section B1 can be structured to be included in the control section B0. In such a structure, the control section B0 controls the elevation drive motor B7 (elevation section) in such a way that the aforementioned sheet bundle is moved up and down, based on the ratio of "sheet existence" or the detection frequency of "sheet existence" in conformity to the result of detection by the sheet detection sensor 51.

[Control Flow]

Figure 10:
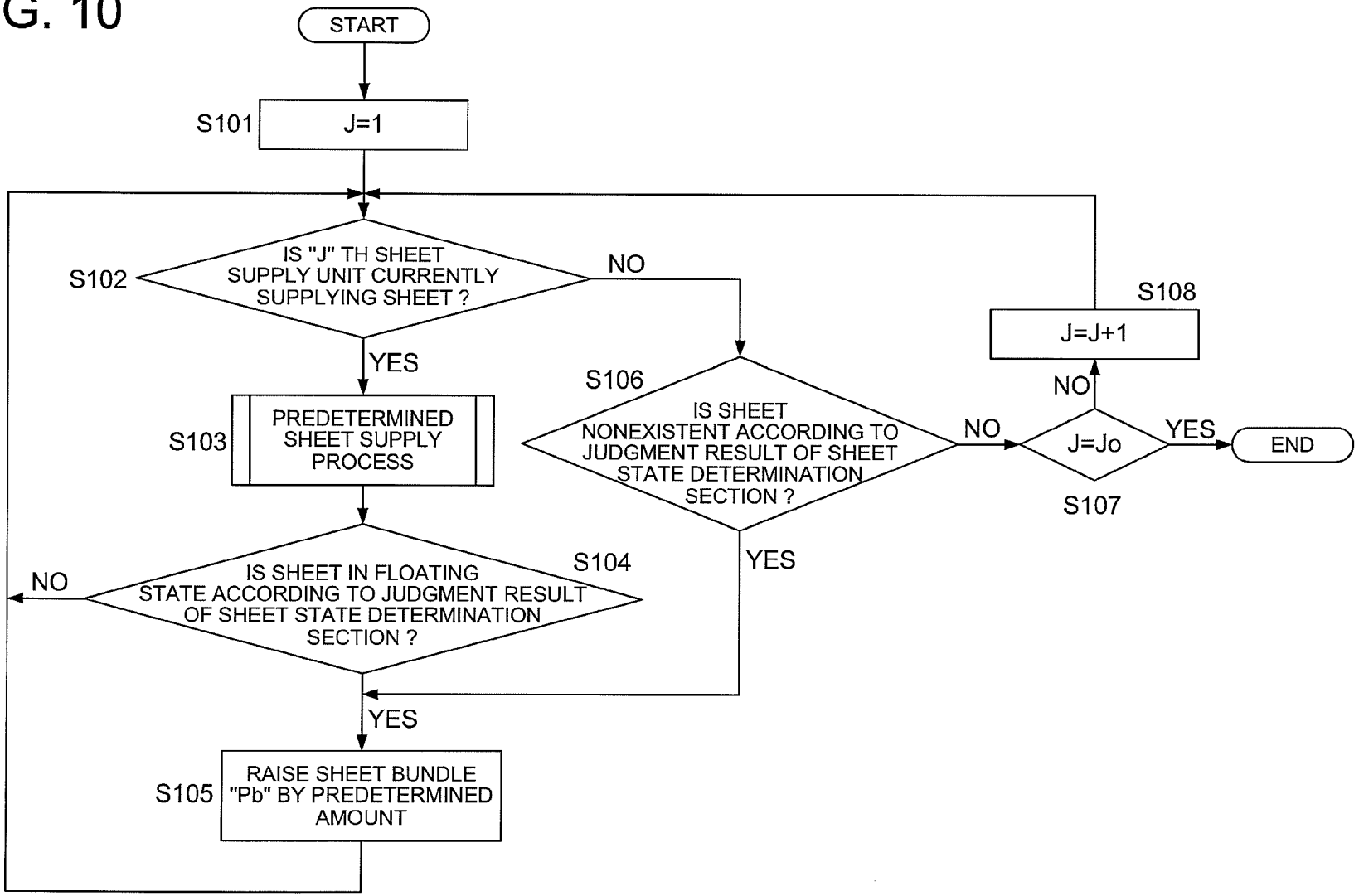
FIG. 10 is a diagram showing the control flow of the sheet supply device B of an embodiment.

FIG. 10 is a diagram showing the control flow of the sheet supply device B of an embodiment. This control flow is implemented by the control section B0 serving as a control section of the sheet supply device B.

The numerals of J=1, 2, 3 are used to specify three sheet supply units 5 in that order from top to bottom. In Step S101 of FIG. 10, the sheet supply unit 5 of the top row is designated, and elevation control for the sheet bundle Pb loaded on each sheet supply unit 5 is executed in the order of J=1, J=2 and J=3 according to the processes of Step S102 through Step S107.

In Step S102, a step is taken to determine whether or not the designated sheet supply unit 5 is in the process of sheet supply. If the result of decision is "YES", namely, "in the process of sheet supply", the control goes to Step S103. If the result of decision is "NO", namely, "in the standby mode", the control goes to Step S106.

Step S103 is a process of executing a "predetermined sheet supply process", which includes an air separation process where air is blown from the blow section to lift the sheet at the uppermost portion of the sheet bundle Pb, and a sheet conveyance process where the floating sheet is absorbed by the sheet absorbing conveyance device 50 and is conveyed one by one to the position downstream of the sheet supply unit 5. The execution of this process ensures that the uppermost point P0 of the sheet bundle Pb stacked on the sheet supply unit 5 is gradually lowered. When a predetermined number of sheets of paper have been supplied, the control goes to Step S104.

Step S104 is the step of selection, wherein the control goes to the Step S105 if the result of decision by the sheet state determination section B1 is the "floating state of sheet", while the control goes back to Step S102 if the result of decision is the "non-floating state of sheet".

Step S105 is the process of driving the elevation drive motor B7 so that the sheet bundle Pb of the sheet placement table 59 will be raised by a predetermined amount. Upon completion of this process, the control goes back to Step S102.

If it has been determined in Step S102 that "the predetermined sheet supply unit is on standby", the control goes to Step S106.

Step S106 is the process wherein, if the result of decision by the sheet state determination section B1 is "a sheet is not present", namely "sheet nonexistence state", the control goes to the Step S105 described above, and if the result of decision is "sheet existence state", the control goes to Step S107.

Step S107 is the process of determining whether or not the predetermined sheet supply unit 5 is the sheet supply unit 5 of final checking. If the predetermined sheet supply unit 5 is the sheet supply unit 5 of final checking, a series of elevation control of sheet supply units 5 will terminate. If the predetermined sheet supply unit 5 is not the sheet supply unit 5 of final checking, the control goes to Step S108. In this embodiment, the predetermined sheet supply unit 5 is the sheet supply unit 5 of final checking if J=3.

Step 108 is the process of designating the next sheet supply unit 5 and shifting the control to the Step S102.

In the aforementioned control flow, the predetermined sheet supply unit 5 out of three sheet supply units 5 is sequentially designated, and sheet bundle elevation control for each sheet supply unit 5 is performed. As a result, in all sheet supply units 5, the uppermost point of the sheet bundle can be maintained at a predetermined position (height) at all times during the sheet supply or on standby.

Figure 11:
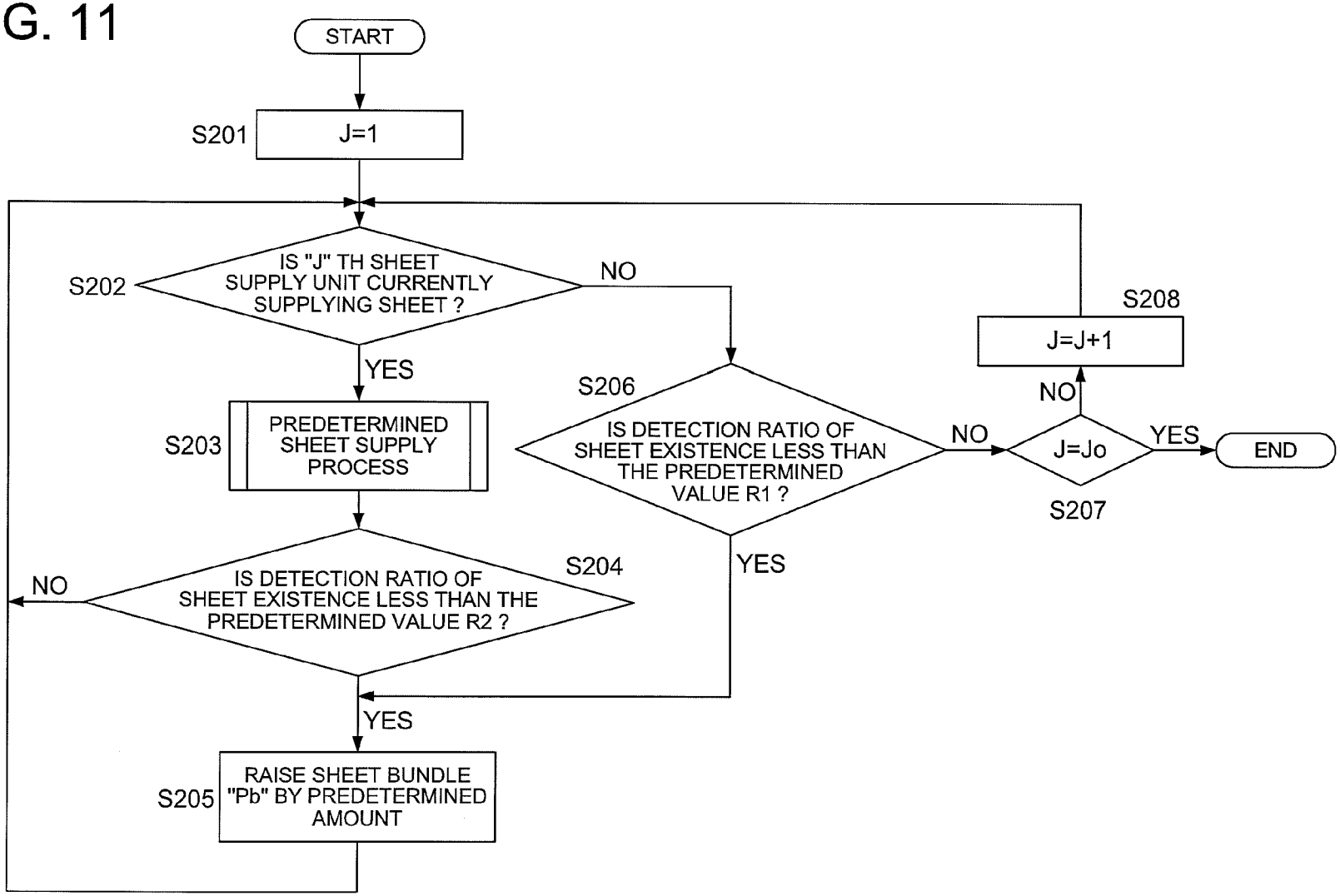
FIG. 11 is a diagram showing the control flow of the sheet supply device B of another embodiment.

FIG. 11 is a diagram showing the control flow in another embodiment. The elevation drive motor B7 (elevation section) is controlled by the control section B0 in such a way that the aforementioned sheet bundle will be moved up and down based on the ratio of "sheet existence" in the result of detection by the sheet detection sensor 51.

The difference from the control flow of FIG. 10 is that the Step S104 is replaced by the Step S204, and the Step S106 of FIG. 10 is replaced by the Step S206. Other processes are the same as those of FIG. 11.

In Step S204, a step is taken to determine whether or not the detection ratio R of the sheet existence detected by the sheet detection sensor 51 is below a predetermined value R2. If the detection ratio R is below the predetermined value R2, the control goes to Step S205. Then the elevation drive motor B7 is driven to move the sheet bundle by a predetermined amount.

In Step S206, if the predetermined sheet supply unit 5 is on standby and the ratio R of detection by the sheet detection sensor 51 is below a predetermined value R1, the control goes to Step S205, and the elevation drive motor B7 is driven to move the sheet bundle by a predetermined amount.

In the air conveyance type sheet supply device of the aforementioned embodiment, use of a non-contact upper surface detecting sensor protects the internally accommodated sheet against possible damage. Further, the sheet bundle is moved up and down in conformity to the detection ratio of sheet existence or detection frequency by the sheet detection sensor during the air blow, whereby the uppermost point of the non-floating sheet bundle can be maintained at the predetermined position at all times during the sheet supply. This makes it possible to provide a sheet supply device and an image forming apparatus using this sheet supply device characterized by excellent sheet supply performances free from a multiple feed or failure of feed, and high speed performances of reduced sheet supply intervals, even when various types of recording media such as gloss coated paper, quality paper, printed paper and recycled paper are used.

In the aforementioned embodiment, the sheet detection sensor 51 also serves the function of the sheet bundle upper position detecting section, which detects the uppermost point of the sheet bundle to move the sheet bundle up and down when the sheet supply unit 5 is placed on standby. It is possible to install a sheet bundle upper position detecting section as a separate structure.

Thus, the present invention provides a sheet supply device capable of accurately detecting the top surface of the sheet bundle without damaging the internally stored sheets, even when this apparatus is an air conveyance type sheet supply device.

What is claimed is:

1. A sheet supply device comprising:

a sheet placement table for storing a plurality of sheets as a sheet bundle;

an elevation section for raising and lowering the sheet bundle stored in the sheet placement table;

a blow section for floating a sheet up from the sheet bundle by blowing air to a side surface of the sheet bundle;

a sheet conveyance section which applies suction to the sheet which has been floated by air blown by the blow section and conveys the sheet which has been absorbed by the suction one by one in a conveyance direction;

a sheet detection sensor provided at a predetermined position of the device so as to detect existence or nonexistence of the sheet at the predetermined position without contact with the sheet; and a control section for controlling the elevation section so as to raise the sheet bundle during an operation of the blow section when a ratio of sheet existence is within a predetermined range or when a frequency of detection is within a predetermined range, wherein the ratio of sheet existence corresponds to a portion of a predetermined time period during which the sheet detection sensor detects sheet existence, and wherein the frequency of detection corresponds to the number of times the sheet detection sensor detects sheet existence during a predetermined time period.

2. The sheet supply device of claim 1, further comprising:

a sheet state determination section for determining the state of the sheet at the predetermined position based on a result of the detection by the sheet detection sensor.

3. The sheet supply device of claim 2, wherein the sheet state determination section determines whether the state of the sheet at the predetermined position is a sheet nonexistence state, a floating state in which the sheet is floating or a non-floating state in which the sheet is not floating.

4. The sheet supply device of claim 2, wherein the control section judges whether the sheet supply device is supplying a sheet or not and the sheet state determination section determines the state of the sheet differently depending on a result of the judgment of the control section.

5. The sheet supply device of claim 4, wherein the sheet state determination section uses a predetermined threshold value for determining the state of the sheet and wherein the control section judges whether the sheet supply device is supplying a sheet or not and the sheet state determination section uses a different threshold value depending on a result of the judgment.

6. The sheet supply device of claim 1, wherein the control section controls the sheet detection sensor to detect an uppermost point of the sheet bundle when the blow section is not operating and controls the elevation section to raise or lower the sheet bundle based on a result of the detection.

7. The sheet supply device of claim 1, wherein the blow section comprises a leading edge blow section for blowing air to a leading edge of the sheet bundle in the conveyance direction and a side surface blow section for blowing air to a side surface of the sheet bundle.

8. The sheet supply device of claim 1, wherein the sheet conveyance section comprises:

a sucking section for sucking the sheet which has been floated up; and an absorbing conveyance belt for absorbing the sheet which has been sucked by the sucking section and for conveying the absorbed sheet.

9. The sheet supply device of claim 1, wherein the sheet detection sensor is provided on a leading edge side of the sheet in the conveyance direction and detects existence or nonexistence of the sheet at the predetermined position on the leading edge side in the conveyance direction without contact with the sheet.

10. The sheet supply device of claim 1, wherein the blow section comprises a shutter for controlling blown air to be used for separation of a sheet from the sheet bundle and for isolation of floating sheets from each other.

11. The sheet supply device of claim 1, wherein the control section controls a plurality of sheet supply units each comprising:

the sheet placement table;

the elevation section;

the blow section;

the sheet conveyance section; and the sheet detection sensor.

12. The sheet supply device of claim 11, wherein the control section controls the plurality of sheet supply units one by one sequentially.

13. An image forming apparatus comprising the sheet supply device of claim 1, and an image forming section for forming an image on the sheet conveyed from the sheet supply device.

14. A sheet supply device comprising:

a sheet placement table for storing a plurality of sheets as a sheet bundle;

an elevation section for raising and lowering the sheet bundle stored in the sheet placement table;

a blow section for floating a sheet up from the sheet bundle by blowing air to a side surface of the sheet bundle;

a sheet conveyance section which applies suction to the sheet which has been floated by air blown by the blow section and conveys the sheet which has been absorbed by the suction one by one in a conveyance direction;

a sheet detection sensor provided at a predetermined position of the device so as to detect existence or nonexistence of the sheet at the predetermined position without contact with the sheet;

a sheet state determination section for determining a state of the sheet at the predetermined position by using a predetermined threshold value based on a result of the detection by the sheet detection sensor; and a control section for controlling the elevation section so as to raise the sheet bundle during an operation of the blow section when the sheet state determination section determines the state of the sheet at the predetermined position to be a floating state based on a result of the detection of the sheet detection sensor, wherein the control section judges whether the sheet supply device is supplying a sheet or not and the sheet state determination section uses a different threshold value depending on a result of the judgment of the control section.

15. An image forming apparatus comprising the sheet supply device of claim 14, and an image forming section for forming an image on the sheet conveyed from the sheet supply device.

16. The sheet supply device of claim 14, wherein the sheet state determination section determines the state of the sheet differently depending on the result of the judgment of the control section.

* * * * *